US009270012B2

(12) United States Patent
Nickel et al.

(10) Patent No.: US 9,270,012 B2
(45) Date of Patent: Feb. 23, 2016

(54) ELECTRONIC DEVICE WITH CALIBRATED TUNABLE ANTENNA

(75) Inventors: Joshua G. Nickel, San Jose, CA (US); Mattia Pascolini, Campbell, CA (US)

(73) Assignee: Apple Inc., Cupertino, CA (US)

( * ) Notice: Subject to any disclaimer, the term of this patent is extended or adjusted under 35 U.S.C. 154(b) by 679 days.

(21) Appl. No.: 13/363,743

(22) Filed: Feb. 1, 2012

(65) Prior Publication Data

US 2013/0194139 A1 Aug. 1, 2013

(51) Int. Cl.

| | |
|---|---|
| ***H01Q 9/00*** | (2006.01) |
| ***H01Q 1/24*** | (2006.01) |
| ***H01Q 9/42*** | (2006.01) |
| ***H01Q 5/328*** | (2015.01) |

(52) U.S. Cl.

CPC ..... *H01Q 1/243* (2013.01); *H01Q 5/328* (2015.01); *H01Q 9/42* (2013.01)

(58) Field of Classification Search

None

See application file for complete search history.

(56) References Cited

U.S. PATENT DOCUMENTS

| | | | | |
|---|---|---|---|---|
| 5,157,357 | A | 10/1992 | Katoh | |
| 6,133,834 | A | 10/2000 | Eberth et al. | |
| 6,362,789 | B1 * | 3/2002 | Trumbull et al. | 343/700 MS |
| 6,630,909 | B2 * | 10/2003 | Nepveu | 343/744 |
| 6,680,703 | B1 | 1/2004 | McConnell | |
| 7,212,789 | B2 * | 5/2007 | Kuffner | 455/83 |
| 7,408,517 | B1 * | 8/2008 | Poilasne et al. | 343/742 |
| 7,786,819 | B2 * | 8/2010 | Ella et al. | 333/17.3 |
| 8,781,420 | B2 * | 7/2014 | Schlub et al. | 455/127.2 |
| 2007/0285326 | A1 * | 12/2007 | McKinzie | 343/746 |
| 2010/0060531 | A1 * | 3/2010 | Rappaport | 343/702 |
| 2013/0109305 | A1 * | 5/2013 | Savoj et al. | 455/41.1 |
| 2013/0154897 | A1 * | 6/2013 | Sorensen et al. | 343/861 |

* cited by examiner

*Primary Examiner* — Trinh Dinh

(74) *Attorney, Agent, or Firm* — Treyz Law Group, P.C.; G. Victor Treyz; Michael H. Lyons

(57) ABSTRACT

An electronic device may have tunable antenna structures. A tunable antenna may have an antenna resonating element and an antenna ground. An adjustable electronic component such as an adjustable capacitor, adjustable inductor, or adjustable phase-shift element may be used in tuning the antenna. An impedance matching circuit may be coupled between the tunable antenna and a radio-frequency transceiver. The adjustable electronic component may be coupled to the antenna resonating element or other structures in the antenna or may form part of the impedance matching circuit, a transmission line, a parasitic antenna element, or other antenna structures. During manufacturing, manufacturing variations may cause the performance of the tunable antenna to deviate from desired specifications. Calibration operations may be performed to identify compensating adjustments to be made with the adjustable electronic component. Calibration data for the adjustable component may be stored in control circuitry in the electronic device.

19 Claims, 12 Drawing Sheets

ELECTRONIC DEVICE WITH CALIBRATED TUNABLE ANTENNA

BACKGROUND

This relates generally to manufacturing, and more particularly, to calibrating electronic device antenna performance during manufacturing.

Electronic devices such as portable computers and cellular telephones are often provided with wireless communications capabilities. For example, electronic devices may use long-range wireless communications circuitry such as cellular telephone circuitry and short-range wireless communications circuitry such as wireless local area network circuitry. To handle wireless communications, electronic devices may be provided with one or more antennas. In some configurations, antennas may include tunable circuitry.

Due to manufacturing variations, antennas may not initially perform according to desired specifications. This may lead to costly rework or may require that antennas be discarded on the manufacturing line. In situations in which antennas are formed using conductive parts of an electronic device housing and situations in which there are multiple antennas in a device, antenna faults due to manufacturing variations may have a significant adverse impact to device yields.

It would therefore be desirable to be able to provide improved ways of manufacturing antennas and electronic devices with antennas.

SUMMARY

An electronic device may have tunable antenna structures. Adjustable components may be used to tune the tunable antenna structures.

Manufacturing variations may cause antenna performance to deviate from design specifications. During manufacturing, wireless test equipment may be used to characterize antenna performance. Antenna performance measurements may be made while using a variety of different settings for the adjustable components that tune the antennas. Antenna performance measurements for each set of settings may be compared to desired performance limits to determine whether compensating adjustments should be made to the adjustable components in an electronic device. Calibration data for the adjustable components in the device may be stored in control circuitry in the device.

A tunable antenna may have an antenna resonating element and an antenna ground. An adjustable electronic component such as an adjustable capacitor, adjustable inductor, or adjustable phase-shift element may be used in tuning the antenna. An impedance matching circuit may be coupled between the tunable antenna and a radio-frequency transceiver. The adjustable electronic component may be coupled to the antenna resonating element or may form part of the impedance matching circuit, a transmission line, a parasitic antenna element, or other antenna structures.

Further features of the invention, its nature and various advantages will be more apparent from the accompanying drawings and the following detailed description of the preferred embodiments.

DETAILED DESCRIPTION

Figure 1:
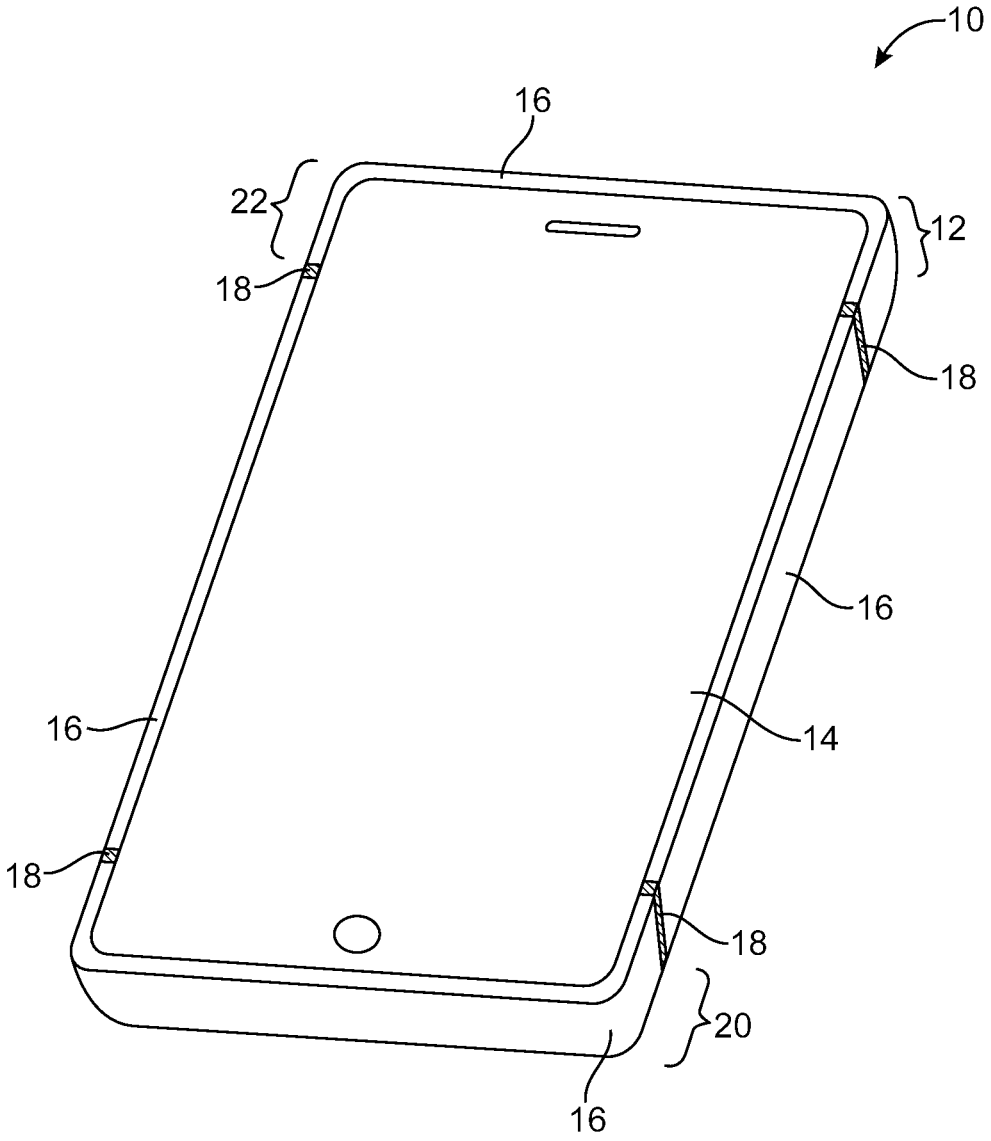
FIG. 1 is a perspective view of an illustrative electronic device of the type that may include wireless circuitry with antenna structures that may be calibrated in accordance with an embodiment of the present invention.

Electronic devices such as electronic device 10 of FIG. 1 may be provided with wireless communications circuitry. The wireless communications circuitry may have one or more antennas and may be used to support wireless communications in one or more wireless communications bands.

Device 10 of FIG. 1 may be a computer monitor with an integrated computer, a desktop computer, a television, a notebook computer, other portable electronic equipment such as a cellular telephone, a tablet computer, a media player, a wristwatch device, a pendant device, an earpiece device, other compact portable devices, or other electronic equipment.

Device 10 may include antenna structures such as loop antennas, inverted-F antennas, strip antennas, planar inverted-F antennas, slot antennas, hybrid antennas that include antenna structures of more than one type, or other suitable antennas. Conductive structures for the antennas may, if desired, be formed from conductive electronic device structures. The conductive electronic device structures may include conductive housing structures. The housing structures may include a peripheral conductive member that runs around the periphery of an electronic device. The peripheral conductive member may serve as a bezel for a planar structure such as a display, may serve as sidewall structures for a device housing, or may form other housing structures. Gaps in the peripheral conductive member may be associated with the antennas.

The size of the gaps that are produced during manufacturing, the size and shapes of the peripheral conductive member and internal ground plane structures formed from parts of an electronic device housing or other conductive structures (e.g., printed circuit board structures), the size and shapes of printed circuit traces that are used in forming antenna structure, impedance matching circuit component variations, transmission line variations, and other manufacturing variations can influence the electrical properties of the antennas that are formed in device 10. For example, manufacturing variations may cause an antenna to exhibit a resonant peak at a different frequency than desired.

To ensure that device 10 performs properly, device 10 and/or antenna structures in device 10 may be tested during manufacturing. The test measurements may reveal undesired antenna performance variations. Compensating calibration adjustments may then be made to adjustable circuitry in device 10. For example, settings for adjustable components in impedance matching circuits and/or antennas may be identified for calibrating the wireless performance of the antenna structures and device 10. Using this approach, each device (and the antenna structures for that device) may be individually calibrated to ensure that its wireless circuitry is satisfying desired performance criteria.

Device 10 of FIG. 1 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material. In other situations, housing 12 or at least some of the structures that make up housing 12 may be formed from metal elements.

Device 10 may, if desired, have a display such as display 14. Display 14 may, for example, be a touch screen that incorporates capacitive touch electrodes. Display 14 may include image pixels formed from light-emitting diodes (LEDs), organic LEDs (OLEDs), plasma cells, electronic ink elements, liquid crystal display (LCD) components, or other suitable image pixel structures. A cover glass layer may cover the surface of display 14. Buttons and speaker port openings may pass through openings in the cover glass.

Housing 12 may include structures such as housing member 16. Member 16 may run around the rectangular periphery of device 10 and display 14. Member 16 or part of member 16 may serve as a bezel for display 14 (e.g., a cosmetic trim that surrounds all four sides of display 14 and/or helps hold display 14 to device 10). Member 16 may also, if desired, form sidewall structures for device 10.

Member 16 may be formed of a conductive material and may therefore sometimes be referred to as a peripheral conductive housing member, conductive housing structures, or peripheral conductive member. Member 16 may be formed from a metal such as stainless steel, aluminum, or other suitable materials. One, two, or more than two separate structures may be used in forming member 16.

It is not necessary for member 16 to have a uniform cross-section. For example, the top portion of member 16 may, if desired, have an inwardly protruding lip that helps hold display 14 in place. If desired, the bottom portion of member 16 may also have an enlarged lip (e.g., in the plane of the rear surface of device 10). In the example of FIG. 1, member 16 has substantially straight vertical sidewalls. This is merely illustrative. The sidewalls of member 16 may be curved or may have any other suitable shape. In some configurations (e.g., when member 16 serves as a bezel for display 14), member 16 may run around the lip of housing 12 (i.e., member 16 may cover only the edge of housing 12 that surrounds display 14 and not the rear edge of the sidewalls of housing 12).

Display 14 may include conductive structures such as an array of capacitive electrodes, conductive lines for addressing pixel elements, driver circuits, etc. Housing 12 may include internal structures such as metal frame members, a planar housing member (sometimes referred to as a midplate) that spans the walls of housing 12 (i.e., a sheet metal structure formed from one or more sections that are welded or otherwise connected between the opposing right and left sides of member 16), printed circuit boards, and other internal conductive structures. These conductive structures may be located in center of housing 12 (as an example).

In regions 20 and 22, openings may be formed between the conductive housing structures and conductive electrical components that make up device 10. These openings may be filled with air, plastic, and other dielectrics. Conductive housing structures and other conductive structures in device 10 may serve as a ground plane for the antennas in device 10. The openings in regions 20 and 22 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, or may otherwise serve as part of antenna structures formed in regions 20 and 22.

Portions of member 16 may be provided with gap structures 18. Gaps 18 may be filled with dielectric such as polymer, ceramic, glass, etc. Gaps 18 may divide member 16 into one or more peripheral conductive member segments. There may be, for example, two segments of member 16 (e.g., in an arrangement with two gaps), three segments of member 16 (e.g., in an arrangement with three gaps), four segments of member 16 (e.g., in an arrangement with four gaps, etc.). The segments of peripheral conductive member 16 that are formed in this way may form parts of antennas in device 10.

Figure 2:
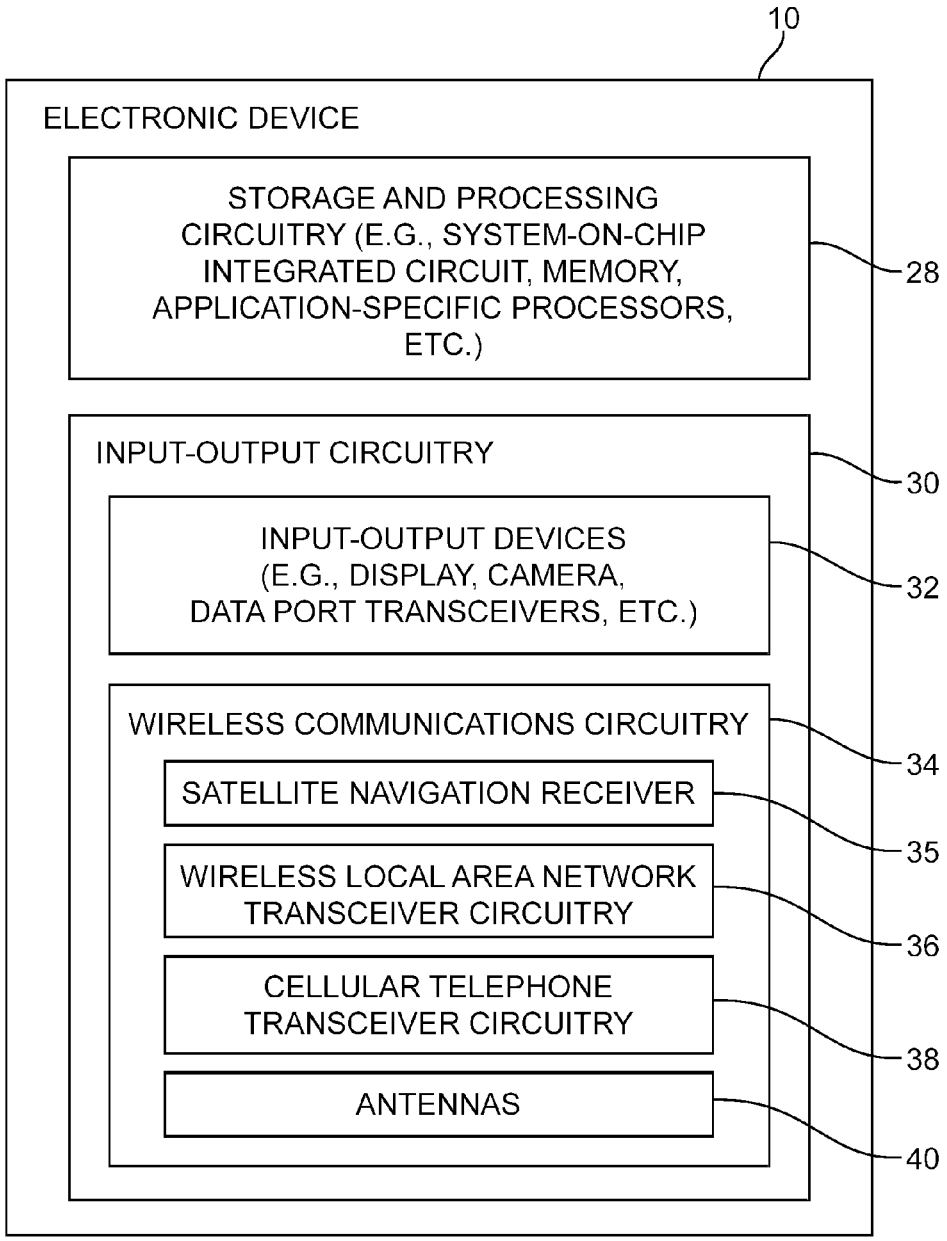
FIG. 2 is a schematic diagram of an illustrative electronic device of the type that may include wireless circuitry with antenna structures that may be calibrated in accordance with an embodiment of the present invention.

A schematic diagram of electronic device 10 is shown in FIG. 2. As shown in FIG. 2, electronic device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. This processing circuitry may be based on one or more system on chip (SoC) integrated circuits, microprocessors, microcontrollers, digital signal processors, baseband processors, power management units, audio codec chips, application specific integrated circuits, memory controllers, timing controllers, etc.

Storage and processing circuitry 28 may be used to run software on device 10, such as internet browsing applications, voice-over-internet-protocol (VoIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, etc.

To support manufacturing operations, circuitry 28 may be configured to implement test and calibration algorithms. For example, circuitry 28 may be configured to direct radio-frequency transceiver circuitry in device 10 to transmit or receive signals at particular frequencies while making power measurements (as an example).

Adjustable components in device 10 may be used to tune antenna performance. For example, device 10 may include tunable impedance matching circuitry, tunable antennas, or other tunable circuitry that can be adjusted to modify the frequency response of the wireless circuitry of device 10. Circuitry 28 may be configured to implement a control algorithm that adjusts components such as adjustable capacitors, adjustable inductors, adjustable phase shifters, and other adjustable circuitry.

Input-output circuitry 30 may be used to allow data to be supplied to device 10 and to allow data to be provided from device 10 to external devices. Input-output circuitry 30 may include input-output devices 32. Input-output devices 32 may include touch screens, buttons, joysticks, click wheels, scrolling wheels, touch pads, key pads, keyboards, microphones, speakers, tone generators, vibrators, cameras, sensors, light-emitting diodes and other status indicators, transceiver circuits associated with data ports, etc. A user can control the operation of device 10 by supplying commands through input-output devices 32 and may receive status information and other output from device 10 using the output resources of input-output devices 32.

Wireless communications circuitry 34 may include radio-frequency (RF) transceiver circuitry formed from one or more integrated circuits, power amplifier circuitry, low-noise input amplifiers, passive RF components, one or more antennas, impedance matching circuits, switches, filters, and other circuitry for handling RF wireless signals. Wireless signals can also be sent using light (e.g., using infrared communications).

Wireless communications circuitry 34 may include satellite navigation system receiver circuitry 35 such as Global Positioning System (GPS) receiver circuitry operating at 1575 MHz and/or receiver circuitry using the Global Navigation System (GLONASS) at 1605 MHz or other satellite navigation systems. Wireless local area network transceiver circuitry 36 may handle 2.4 GHz and 5 GHz bands for WiFi® (IEEE 802.11) communications and may handle the 2.4 GHz Bluetooth® communications band. Circuitry 34 may use cellular telephone transceiver circuitry 38 for handling wireless communications in cellular telephone bands such as bands at about 700 MHz to about 2200 MHz or other cellular telephone bands of interest. Wireless communications circuitry 34 can include circuitry for other short-range and long-range wireless links if desired. For example, wireless communications circuitry 34 may include wireless circuitry for receiving radio and television signals, paging circuits, near field communications circuitry, 60 GHz communications circuitry, etc. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include one or more antennas 40. Antennas 40 may be formed using any suitable antenna types. For example, antennas 40 may include antennas with resonating elements that are formed from loop antenna structure, patch antenna structures, inverted-F antenna structures, closed and open slot antenna structures, planar inverted-F antenna structures, helical antenna structures, strip antennas, monopoles, dipoles, hybrids of these designs, etc. Different types of antennas may be used for different bands and combinations of bands. For example, one type of antenna may be used in forming a local wireless link antenna and another type of antenna may be used in forming a remote wireless link. If desired, a single antenna with one or more feeds may be used to handle multiple types of signals. For example, a single antenna may be used to handle wireless local area network traffic at 2.4 GHz, satellite navigation signals, and cellular telephone signals (as an example).

Figure 3:
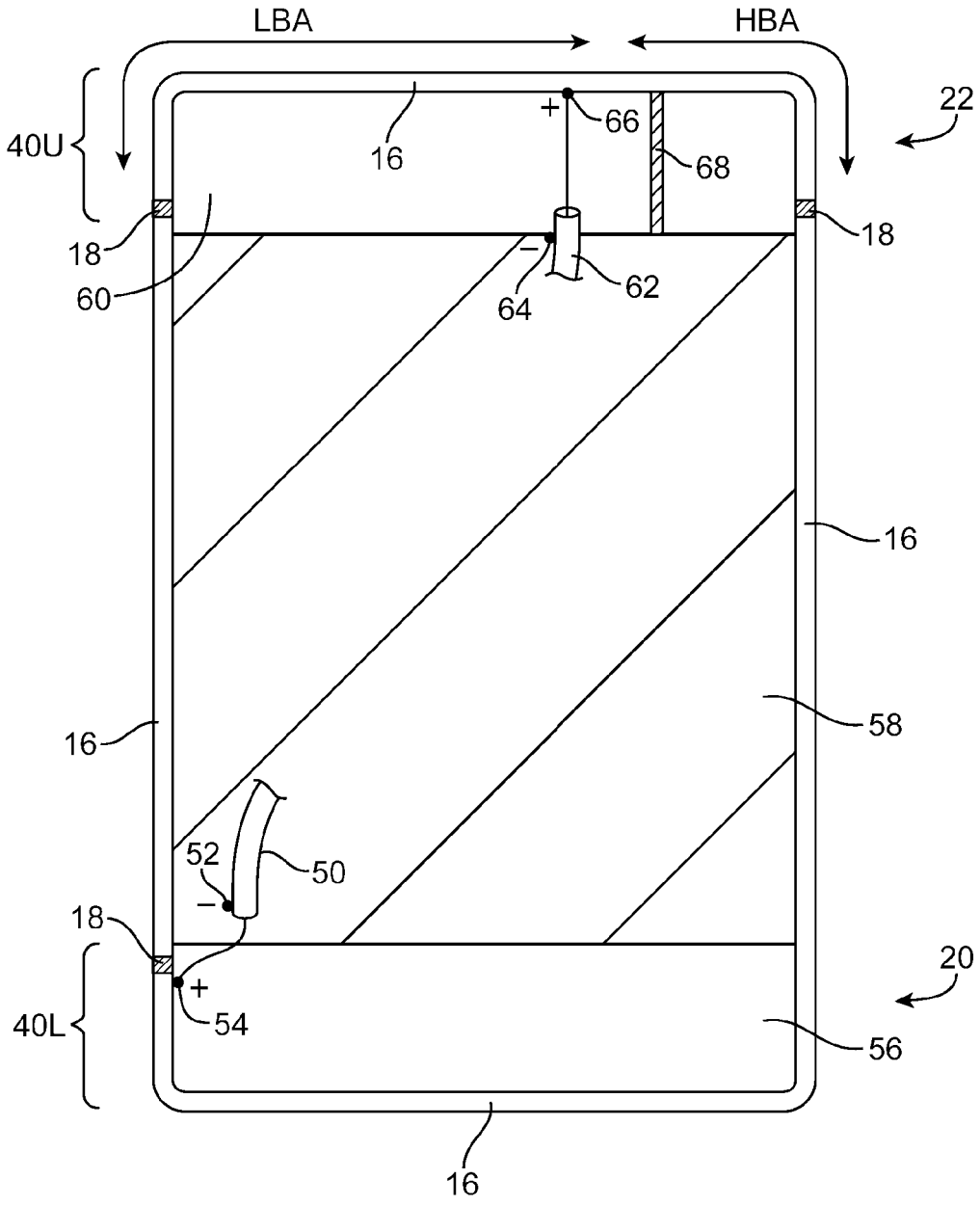
FIG. 3 is a top view of an electronic device having conductive housing structures such as a segmented peripheral conductive member and planar mid-plate structures that may be used in forming antenna structures in accordance with an embodiment of the present invention.

A top view of an interior portion of device 10 is shown in FIG. 3. If desired, device 10 may have upper and lower antennas (as an example). An upper antenna such as antenna 40U may, for example, be formed at the upper end of device 10 in region 22. A lower antenna such as antenna 40L may, for example, be formed at the lower end of device 10 in region 20. The antennas may be used separately to cover separate communications bands of interest or may be used together to implement an antenna diversity scheme or a multiple-input-multiple-output (MIMO) antenna scheme.

Antenna 40L may be formed from the portions of midplate 58 and peripheral conductive housing member 16 that surround dielectric-filled opening 56. Antenna 40L may be fed by transmission line 50, which is coupled to positive feed terminal 54 and ground feed terminal 52. Other feed arrangements may be used if desired. The arrangement of FIG. 3 is merely illustrative.

Antenna 40U may be formed from the portions of midplate 58 and peripheral conductive housing member 16 that surround dielectric-filled opening 60. Member 16 may have a low-band segment LBA that terminates at one of gaps 18 and a high-band segment HBA that terminates at another one of gaps 18. Antenna 40U may be fed using transmission line 62. Transmission line 62 may be coupled to positive antenna feed terminal 66 and ground antenna feed terminal 64 (as an example). Conductive member 68 may span opening 60 to form an inverted-F antenna short-circuit path. Segments LBA and HBA may form low-band and high-band cellular telephone inverted-F antennas (as an example).

If desired, the positions of antennas 40U and 40L may be reversed (i.e., antenna 40U may be formed in region 20 and antenna 40L may be formed in region 22. Configurations in which antennas 40 are formed in other portions of device 10 may also be used.

Figure 4:
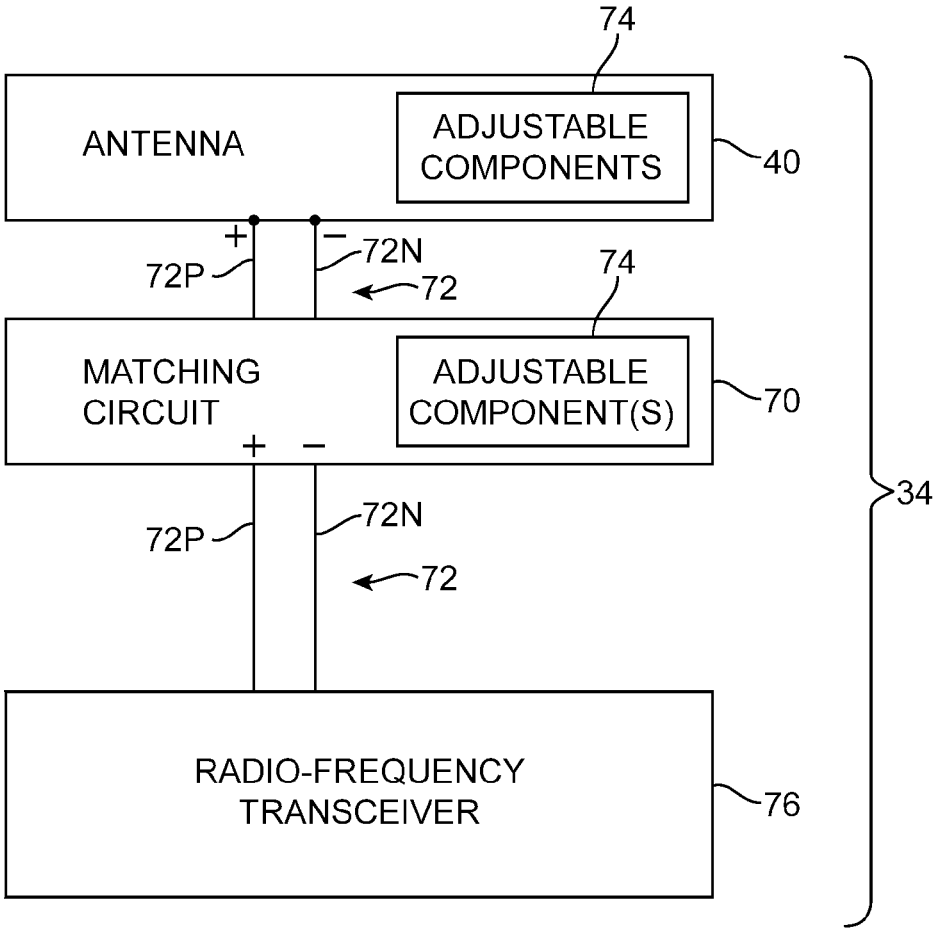
FIG. 4 is a circuit diagram showing how radio-frequency transceiver circuitry may be coupled to antenna structures using an impedance matching circuit such as impedance mating circuitry that includes one or more adjustable components in accordance with an embodiment of the present invention.

As shown in FIG. 4, wireless circuitry 34 may include impedance matching circuitry such as impedance matching circuitry 70 (e.g., for each antenna and/or each antenna feed in device 10). Matching circuitry 70 may include a network of one or more switches, filters, discrete components such as inductors, resistors, and capacitors, and one or more adjustable components such as adjustable components 74. One or more adjustable components 74 may also be incorporated into other portions of wireless circuitry 34 such as antenna 40, part of a transmission line, part of a parasitic antenna element, etc.

The performance of antenna 40 may be tuned by adjusting adjustable components 74 in impedance matching circuitry 70 and/or antenna 40. Tuning may be used in real time during the operation of antenna 40 to allow antenna 40 to cover desired communications bands of interest. To accommodate manufacturing variations, adjustable component 74 may be controlled using calibration data. The calibration data may include, for example, compensating offset settings to be used when adjusting an adjustable component. By applying the calibration data (e.g., compensating offsets) when adjusting adjustable components 74, the wireless performance of device 10 may be assured of meeting design specifications.

Transmission lines such as transmission line 72 may be used to couple transceiver circuitry 76 (e.g., transceiver circuitry such as transceiver circuitry 35, 36, and/or 38 of FIG. 2) to antenna structures such as antenna 40. Transmission line 72 may be formed from coaxial cable, a microstrip transmission line structure, a stripline transmission line structure, transmission line structures that are formed from other structures or combinations of these structures. Transmission line 72 may include a positive signal conductor such as signal line 72P and a ground signal conductor such as ground signal line 72N. Matching circuitry 70 may be interposed within transmission line 72 between radio-frequency transceiver circuitry 76 and antenna 40. Antenna 40 may have an antenna feed made up of a positive antenna feed terminal (+) to which positive signal lines 72P is coupled and a ground antenna feed terminal (−) to which ground signal lines 72N is coupled (i.e., antenna feed terminals such as terminals 66, 64, 54, and 52 of FIG. 3).

Antennas such as antenna 40 may be located at upper end 22 or lower end 20 of device housing 12 or may be located at other portions of device housing 12 (e.g., along a device edge, in the center of a rear housing wall, etc.).

Each antenna 40 may, if desired, be provide with adjustable components such as adjustable components 74. Adjustable components 74 may also be incorporated into a matching circuit such as matching circuit 70. Adjustable components 74 may include varactors, variable resistors, switch-based components such as variable capacitors and inductors that respectively exhibit multiple discrete capacitance or inductance values, adjustable phase shift components, or other adjustable circuitry. Adjustable components 74 may be controlled using analog or digital control signals. For example, a 32 bit digital control signal may be used to place an adjustable component in a desired state out of 32 available states. Digital control signals with other bit widths may be used for controlling adjustable components with other numbers of states. Digital control signals may, in general, be a one bit signal, a two bit signal, a signal with more than two bits, a signal with two to 128 bits, a signal with 32, 64, or 128 bits, etc.

During calibration operations, the wireless performance of device 10 can be measured using test equipment and corresponding calibration adjustments may be made using adjustable components 74, so that device 10 exhibits desired wireless performance.

Figure 5:
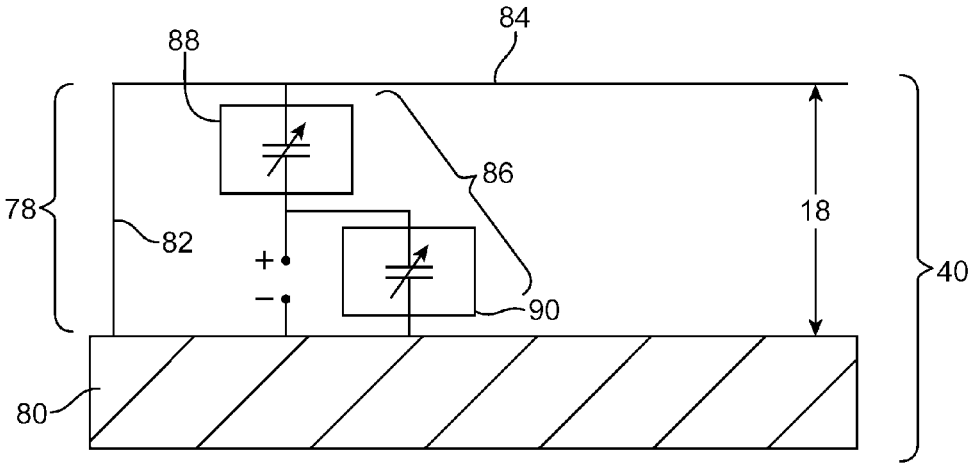
FIG. 5 is a diagram of an illustrative antenna having adjustable circuits with adjustable capacitors in accordance with an embodiment of the present invention.

FIG. 5 is a schematic diagram of an illustrative antenna such as antenna 40 of FIG. 4. Antenna 40 may be located at the upper or lower end of device 10 or may be mounted in other suitable locations within device housing 12. Antenna 40 may have an antenna feed with a positive antenna feed terminal (+) and a ground antenna feed terminal (−). Transmission line 72 (FIG. 4) may have respective positive and ground conductors that are coupled to the positive and ground antenna feed terminals.

In the illustrative configuration of FIG. 5, antenna 40 has antenna resonating element 78 and antenna ground 80. Antenna resonating element 78 may be, for example, an inverted-F antenna resonating element. Resonating element 78 may include a main resonating element arm such as arm 84. Short circuit branch 82 may be coupled between main resonating element arm 84 and ground 80. Antenna resonating element 78 may have a feed branch such as feed branch 86 that is coupled in parallel with short circuit branch 82 between main resonating element arm 84 and ground 80. Some or all of the conductive structures in antenna 40 such as arm 84 and branch 82 may be formed from conductive housing structures. For example, arm 84 and branch 82 may be formed from a segment of peripheral conductive member 16 at the upper or lower end of housing 12 in FIG. 3. The end of arm 84 may be separated from ground 80 by a gap such as gap 18 (FIG. 3).

Figure 6:
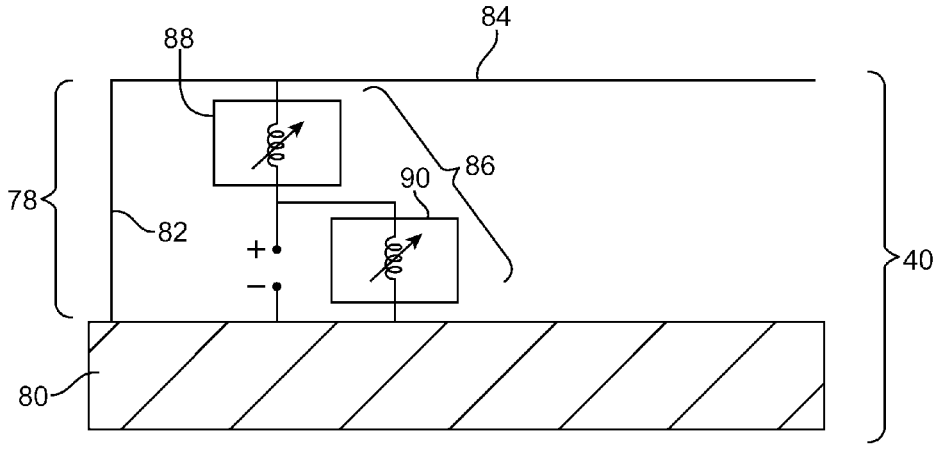
FIG. 6 is a diagram of an illustrative antenna having adjustable circuits with adjustable inductors in accordance with an embodiment of the present invention.

Antenna 40 may have one or more adjustable components such as components in adjustable circuit 88 and adjustable circuit 90. As shown in FIG. 5, adjustable circuit 88 may be interposed in antenna feed branch 86 between the antenna feed and main antenna resonating element arm 84. Adjustable circuit 90 may be coupled in parallel with the antenna feed (i.e., circuit 90 may be bridge the (+) and (−) antenna feed terminals). If desired, control circuitry 28 (FIG. 2) may issue digital or analog control signals to adjustable circuit 88 and/or adjustable circuit 90 in real time during the operation of device 10 to dynamically tune antenna 40 to cover desired communications bands of interest. Control circuitry 28 may also apply an offset or other calibration data when adjusting circuits 88 and 90, so that antenna 40 and device 10 performs according to design specifications. As shown in the example of FIG. 5, adjustable circuits 88 and 90 may be adjustable capacitors or may contain adjustable capacitors. As shown in the example of FIG. 6, adjustable circuits 88 and 90 may be adjustable inductors or may contain adjustable inductors. These are merely illustrative examples. Adjustable circuits 88 and 90 may be formed from any suitable network of adjustable components.

In the examples of FIGS. 5 and 6, antenna 40 is based on an inverted-F design having a single main resonating element arm. If desired, antenna 40 may be an inverted-F antenna that has a main resonating element arm with multiple branches each of which covers a separate communications band (see, e.g., arm segments LBA and HBA in the illustrative T-shaped dual band inverted-F antenna of FIG. 3) or may be implemented using other types of antenna (e.g., a loop antenna design, a planar inverted-F antenna, etc.).

Figure 7:
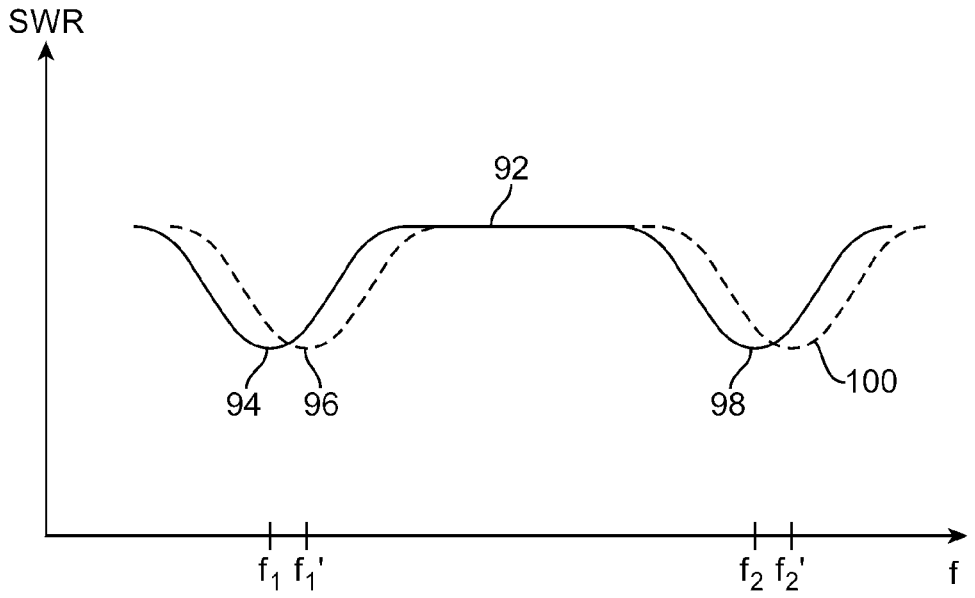
FIG. 7 is a graph showing how adjustable impedance matching circuitry and adjustable antenna components may be used in tuning antenna performance by adjusting low band and high band antenna resonance peaks in accordance with an embodiment of the present invention.

FIG. 7 is an antenna performance graph for an illustrative adjustable dual band antenna (e.g., an antenna of the type shown in FIG. 3 that has a low band segment LBA that resonates in a low communications band and that has a high band segment HBA that resonates in a high communications band). Adjustable components such as adjustable components 74 of FIG. 4 (e.g., adjustable capacitors, adjustable inductors, adjustable phase shifters, or other adjustable circuitry) may be used in the antenna to provide the antenna with adjustability.

In the graph of FIG. 7, antenna performance (standing wave ratio SWR) has been plotted as a function of operating frequency f. As shown by curve 92, when operating with its nominal settings for its adjustable circuits, the antenna may exhibit a first antenna resonance peak such as peak 94 at resonant frequency f1 and may exhibit a second antenna resonance peak such as peak 98 at resonant frequency f2. Frequency f1 may be associated with a low communication band and frequency f2 may be associated with a high communications band (as an example).

Due to manufacturing variations, not all antennas will satisfy desired operating criteria. For example, variations in the size and shape of conductive housing structures such as peripheral conductive housing member 16 and midplate 58, variations in circuit components in device 10, variations in conductive antenna traces on a flexible printed circuit, rigid printed circuit, or other substrate, variations in transmission line structures, or other manufacturing variations may cause the antenna to exhibit a frequency response in which curve 94 is undesirably shifted to frequency f1' and in which curve 98 is undesirably shifted to frequency f2'.

To compensate for this undesired variation in the performance of antenna 40 and device 10 from design specifications, device 10 may be calibrated during manufacturing. For example, after device 10 has been assembled, radio-frequency test measurements may be made to characterize the locations of peaks 96 and 100. Suitable offsets for use in operating adjustable components 74 or other calibration data may then be provided to device 10. Device 10 may maintain the calibration data in storage and processing circuitry 28. During operation, device 10 may apply the calibration data so that antenna 40 exhibits the performance characteristic given by line 92 (e.g., resonance peak 94 rather than erroneous resonance peak 96 and resonance peak 98 rather than erroneous resonance peak 100), as desired. If desired, device 10 may also dynamically adjust the calibrated antenna (e.g., to switch different frequency bands into and out of use during different modes of operation). Each band in this type of multiband antenna may be calibrated using appropriate calibration data.

Because adjustable component calibration data can be used to compensate for manufacturing variations that affect antenna performance, product yields may be increased, particularly in devices with multiple antennas and/or communications bands that are sensitive to performance variations.

Figure 8:
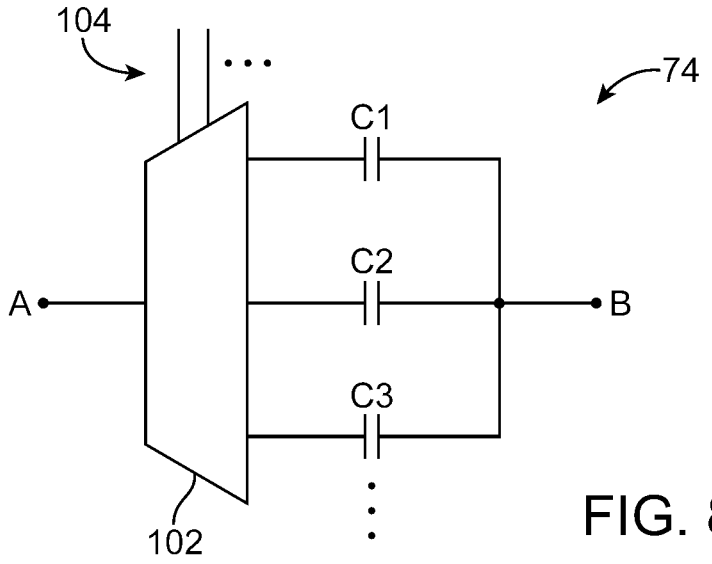
FIG. 8 is a diagram of an adjustable capacitor in accordance with an embodiment of the present invention.

FIG. 8 is a circuit diagram of an illustrative adjustable component 74. In the example of FIG. 8, adjustable component 74 is based on multiple capacitors having respective capacitances (i.e., capacitances C1, C2, C3, etc.). Switch 102 may receive analog and/or digital control signals on one or more control lines in control path 104. Switch 102 may have a terminal that is coupled to terminal A of adjustable component 74 and may have multiple terminals that are connected respectively to the different capacitors in component 74. By adjusting the state of switch 102, a desired, capacitance (C1, C2, C3, etc.) may be switched into place between terminals A and B. If desired, an adjustable capacitor may be implemented using a continuously variable adjustable capacitor. The example of FIG. 8 in which adjustable component 74 has been implemented using a switch-based adjustable capacitor that exhibits a plurality of different capacitances (C1, C2, C3, etc.) is merely illustrative.

Figure 9:
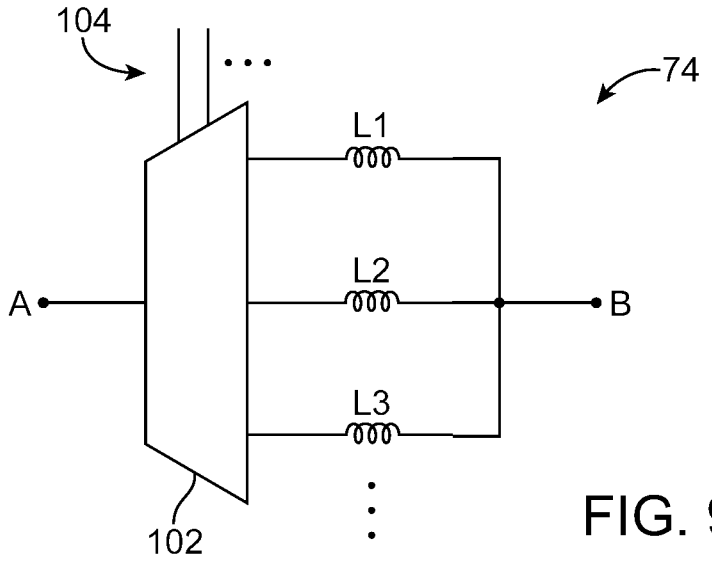
FIG. 9 is a diagram of an adjustable inductor in accordance with an embodiment of the present invention.

As shown in the illustrative configuration of FIG. 9, adjustable component 74 may be based on multiple inductors having respective inductances (L1, L2, L3, etc.). Switch 102 may receive analog and/or digital control signals on one or more control lines in control input path 104. Switch 102 may have a terminal that is coupled to terminal A of adjustable component 74 and may have multiple terminals that are connected respectively to the different inductors in component 74. By adjusting the state of switch 102, a desired, inductance (L1, L2, L3, etc.) may be switched into place between terminals A and B. If desired, an adjustable inductor, adjustable resistor, or other adjustable component may be implemented using a continuously variable adjustable component. The example of FIG. 9 in which adjustable component 74 has been implemented using a switch-based adjustable inductor that exhibits a plurality of different inductances L1, L2, L3, etc. is merely illustrative.

Adjustable switch circuitry 102 may be formed from a single switch (e.g., a switch with multiple terminals each of which is coupled to a respective component such as a capacitor or inductor). Alternatively, adjustable component 74 may be implemented using a network of switches (i.e., switch 102 may include multiple sub-switches). The use of a network of switches connected in series and/or in parallel with capacitors, inductors, or other components within adjustable component 74 may allow component 74 to efficiently produce a relatively large number of parameter values (e.g., separate capacitances, inductances, etc.).

Adjustable components 74 may be implemented using microelectromechanical systems (MEMS) devices, using solid state devices (e.g., one or more integrated circuits), using devices packaged using surface mount technology (i.e., SMT adjustable components), or other suitable parts.

Figure 10:
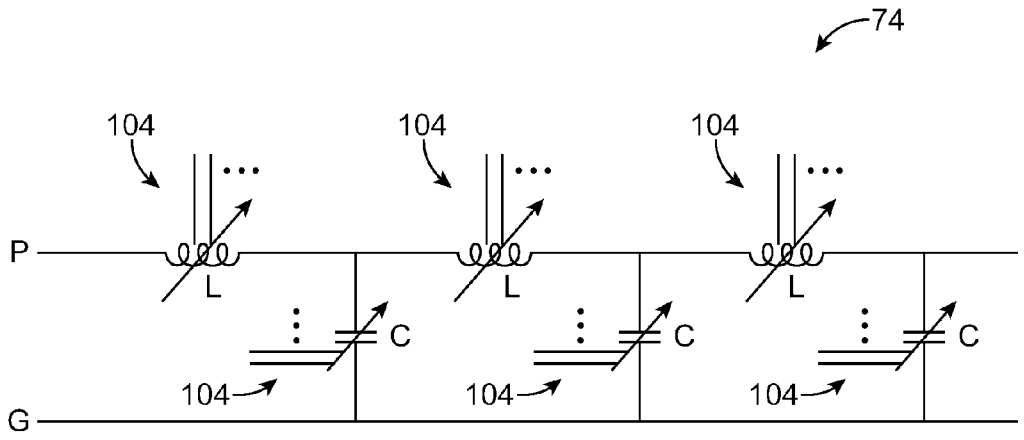
FIG. 10 is a diagram of an illustrative adjustable phase-shift element that may be used in a matching circuit, transmission line, or other wireless circuit to tune antenna performance in accordance with an embodiment of the present invention.

If desired, adjustable components such as adjustable phase shifters may be used in antenna 40, in antenna matching circuit 70, or in other antenna structures (e.g., in part of a transmission line, etc.). An illustrative circuit configuration that may be used for an adjustable phase shifter is shown in FIG. 10. With an arrangement of the type shown in FIG. 10, variable components such as series-connected inductors L and/or shunt-connected capacitors C may be adjusted to produce desired amounts of phase shift along the path made up of parallel signal lines P and G, thereby tuning the performance of antenna 40, as described in connection with FIG. 7. Inductors L may be, for example, switch-based inductors of the type shown in FIG. 9 that exhibit two or more switchable inductance values. Capacitors C may be, for example, switch-based capacitors of the type shown in FIG. 8 that exhibit two or more switchable capacitance values. Control inputs 104 may receive control signals from control circuitry 28 that adjust the amount of phase shift that is produced. If desired, combinations of fixed and adjustable components may be used in the phase shift circuit of FIG. 10.

Control circuitry 28 may maintain information on how to adjust adjustable component(s) 74 to produce desired antenna performance characteristics for device 10. For example, control circuitry 28 may maintain tables or other data structures that indicate how each adjustable component should be configured to produce each of a plurality of desired frequency responses for antenna structures 40. If, for example, device 10 desires to transmit and/or receive signals in a first communications band, control circuitry 28 may use a first set of settings for adjustable components 74 to ensure that the antenna is configured properly to operate in the first communications band. If device 10 desires to transmit and/or receive signals in a second communications band, control circuitry 28 may use a second set of settings for adjustable components 74 to ensure that the antenna is tuned to operate in the second communications band. Any suitable number of communications bands may be covered using antenna tuning techniques such as these (e.g., one or more, two or more, three or more, etc.). Moreover, any suitable number of antennas 40 in device 10 may be tuned (e.g., one or more two or more, three or more, etc.).

To make accurate adjustments to antenna structures (and/or associated impedance matching circuits or other circuitry that tunes antenna performance), device 10 and its associated antenna structures 40 and other wireless circuitry 34 can be calibrated during manufacturing. Calibration operations may be performed on a lot-to-lot basis, or, for enhanced accuracy, on a device-to-device (or antenna-to-antenna) basis.

Figure 11:
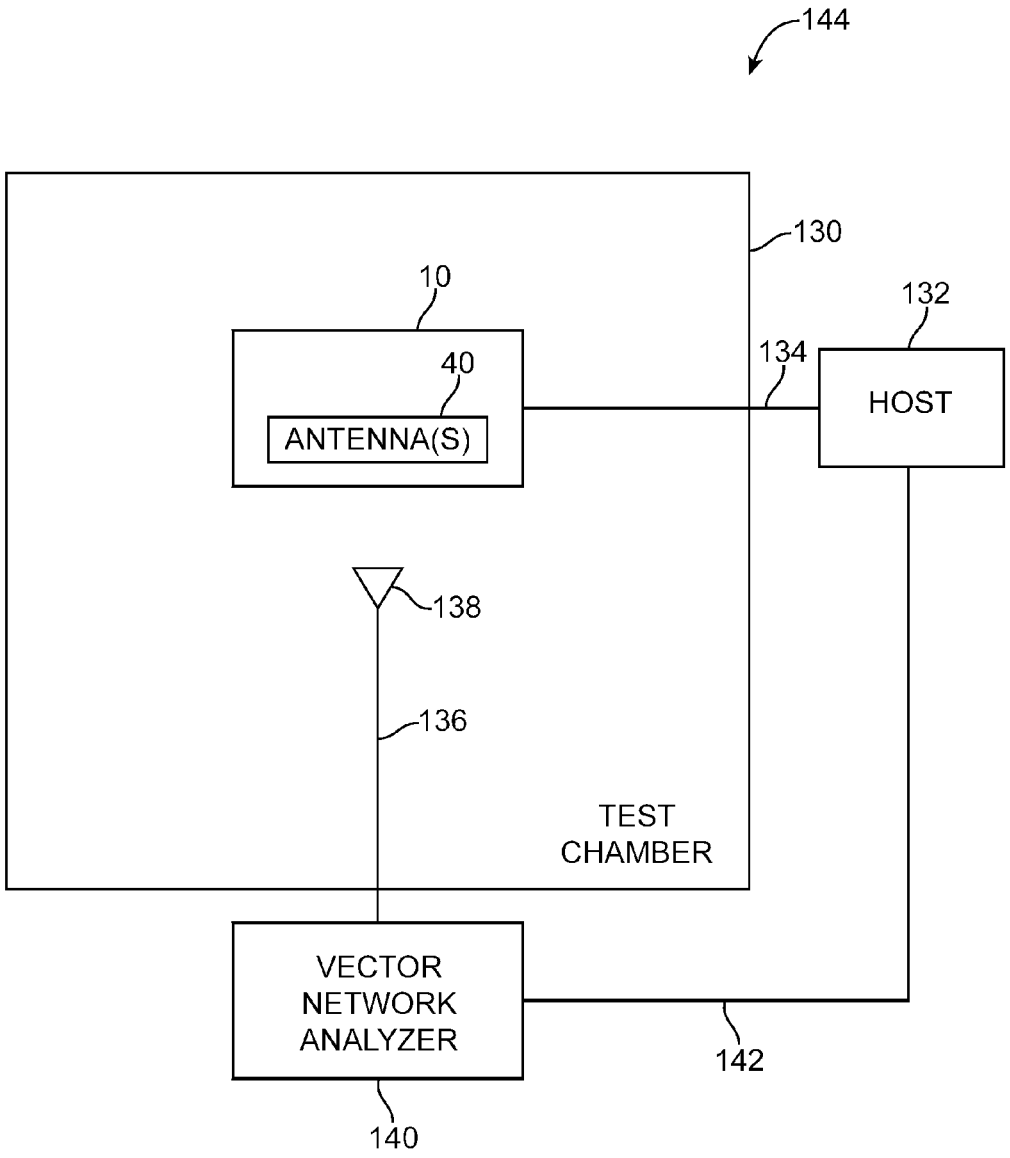
FIG. 11 is a diagram of an illustrative system that may be used in calibrating wireless electronic devices and antenna structures in accordance with an embodiment of the present invention.

An illustrative system that may be used in performing calibration operations is shown in FIG. 11. As shown in FIG. 11, system 144 may include test equipment for testing device 10 and antenna structures 40. Device 10 and antenna structures 40 may be tested in fully assembled form or antenna structures 40 and/or device 10 may be tested in other states. For example, antenna structures 40 may be wirelessly tested before being installed in a completed device housing (e.g., in situations in which antenna structures 40 are not formed from conductive device housing members). As another example, antenna structures 40 may include a conductive device housing member and may be tested following formation of a partly complete device (e.g., a device that includes all of the relevant conductive housing members for forming antenna structures 40, but which does not yet include some portions of a fully completed device). The testing of antenna structures 40 and device 10 using a fully formed device may tend to be more accurate than the testing of antenna structures in partly completed devices or other incomplete device configurations, so examples in which wireless antenna performance testing for device 10 is performed on device 10 after the structures of device 10 have been assembled to form a full device are sometimes described herein as an example.

To reduce radio-frequency interference, wireless testing of device 10 may be performed in a test chamber such as test chamber 130 (e.g., a metal enclosure). Test host 132 (e.g., computing equipment such as one or more computers) may be coupled to device 10 using cable 134. Test antenna 138 may be located within test chamber 130 and may be coupled to wireless test equipment such as a spectrum analyzer, power meter, network analyzer, or other test equipment. As shown in FIG. 11, for example, test antenna 138 may be coupled to vector network analyzer 140 by cable 136. Path 134 may be a digital signal bus formed from one or more parallel lines. Path 136 may be a transmission line such as a coaxial cable for handing radio-frequency test signals. One or more paths such as path 142 may be used to interconnect pieces of test equipment in system 130 such as test host 132 and vector network analyzer 140.

Test system 144 may be used to make wireless radio-frequency test measurements that characterize the wireless performance of device 10. For example, vector network analyzer 140 may use test antenna 138 to transmit radio-frequency test signals to device 10 while antenna structures 40 and receiver circuitry in device 10 are being used to receive these signals. Information on which signals are being transmitted by vector network analyzer 140 may be provided to host 132 via path 142. Information on which corresponding signals are received by device 10 may be provided by device 10 to host 132 by path 134.

Vector network analyzer 140 may also use test antenna 138 to receive wireless test signals that are being transmitted by device 10 using antenna(s) 40. Information on which signals are being transmitted by device 10 may be provided to host 132 via path 134. Information on which corresponding signals are received by vector network analyzer 140 may be provided by vector network analyzer 140 to host 132 by path 142. Using information on transmitted and received signals, host 132 can determine the performance of antenna(s) 40 in device 10 as a function of operating frequency. Performance can be quantified using any suitable antenna performance metric (e.g., S11 parameter data or standing wave ratio data, etc.).

Figure 12:
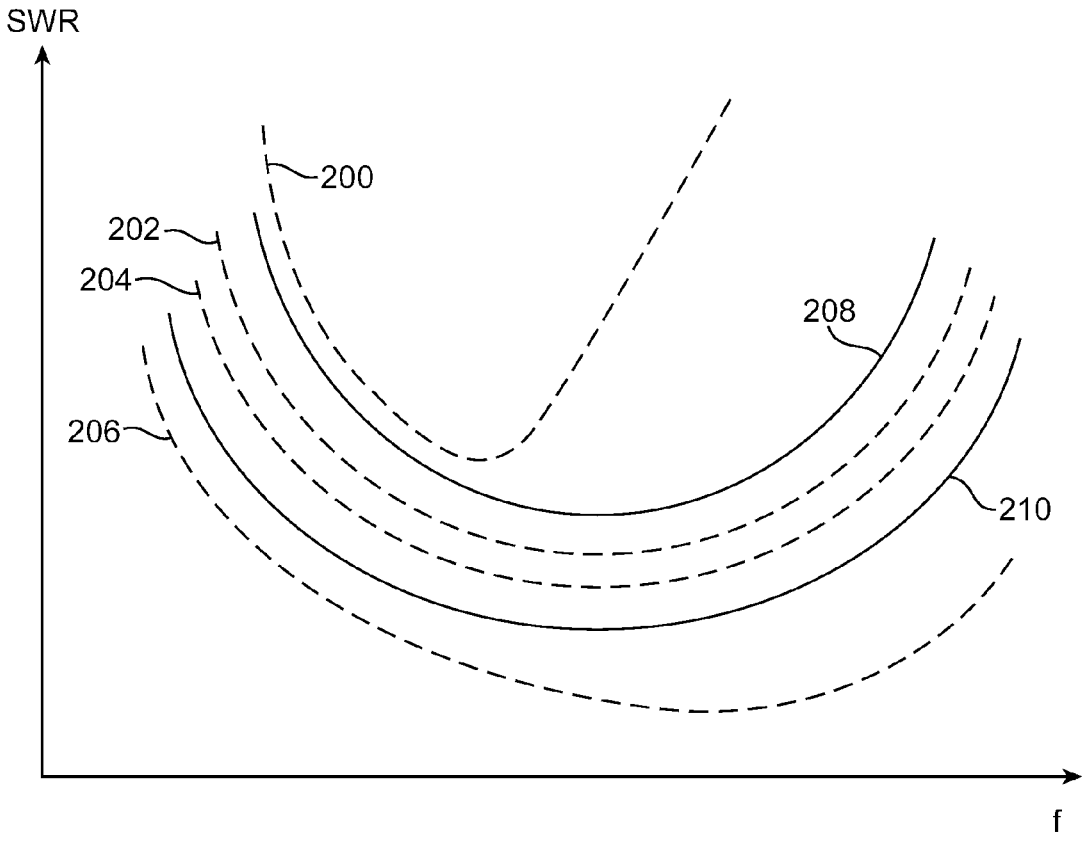
FIG. 12 is a graph showing how antenna performance may vary in response to the use of different adjustable component settings and how antenna performance may be compared to predefined performance limits to determine whether calibrating adjustments should be made in accordance with an embodiment of the present invention.

After making wireless antenna performance measurements to characterize the wireless performance of device 10, host 132 or other computing equipment may analyze the wireless antenna performance measurements. As shown in FIG. 12, for example, antenna performance measurements (e.g., standing-wave-ratio measurements or other performance measurement) such as measurements 200, 202, 204, and 206 may be compared to predefined acceptable performance criteria such as upper limit 208 and lower limit 210. In the example of FIG. 12, performance measurements have been made in a frequency range that covers a single antenna resonance peak. If desired, antenna performance measurements may be made that cover multiple antenna resonance peaks (and corresponding communications bands of interest). The data that is acquired need not be captured in the form of continuous curves of data, but may, if desired, be made up of a limited number of discrete points. The use of measurement curves and corresponding upper and lower threshold limits that have been plotted as curves on the graph of FIG. 12 is merely illustrative.

The upper and lower satisfactory performance limits of FIG. 12 define maximum and minimum acceptable values for the antenna performance measurements (in the FIG. 12 example). An antenna that exhibits measurements 200 or 206 would not be acceptable, because these performance characteristics do not fall within the acceptable performance limits (limits 208 and 210).

In some situations, device 10 will perform within acceptable performance limits using default settings for adjustable components 74. In this type of scenario, device 10 may be said to "pass" wireless performance testing and can be allowed to proceed to further test stations (if any) before being finalized as a device to ship to a user using the default settings.

In other situations, however, device 10 may initially exhibit unacceptable performance but may, with use of appropriate calibration settings for adjustable components 74, be able to perform satisfactorily. As an example, an antenna might initially be characterized as exhibiting performance characteristic 206 of FIG. 12. This performance does not satisfy performance criteria 208 and 210, so the antenna may be retested using different settings for one or more adjustable components 74 until a satisfactory calibration setting is found.

If, as an example, the frequency band in FIG. 12 corresponds to a low band in a dual-band antenna of the type shown in FIG. 5, the adjustable capacitor in adjustable circuit 88 may be used to adjust the frequency peak associated with the low band antenna resonance. Adjustments to the adjustable capacitor in circuit 90 may be used to make high band adjustments in a dual-band antenna (as an example). In an antenna configuration of the type shown in FIG. 6, the adjustments to the adjustable inductor in adjustable circuit 88 may be used to make high-band antenna performance adjustments and adjustments to the adjustable inductor in adjustable circuit 90 may be used to make low-band antenna performance adjustments (as examples). Adjustable phase shift elements such as element 10 may also be used to make antenna performance adjustments. In general, adjustable components 74 for making antenna performance adjustments may form part of an antenna (e.g., part of an antenna resonating element, part of an antenna ground, etc.), may form part of an impedance matching circuit, may form part of a transmission line structure, may form part of a parasitic antenna resonating element, or may form part of any other conductive structures that affect antenna performance.

Figure 13:
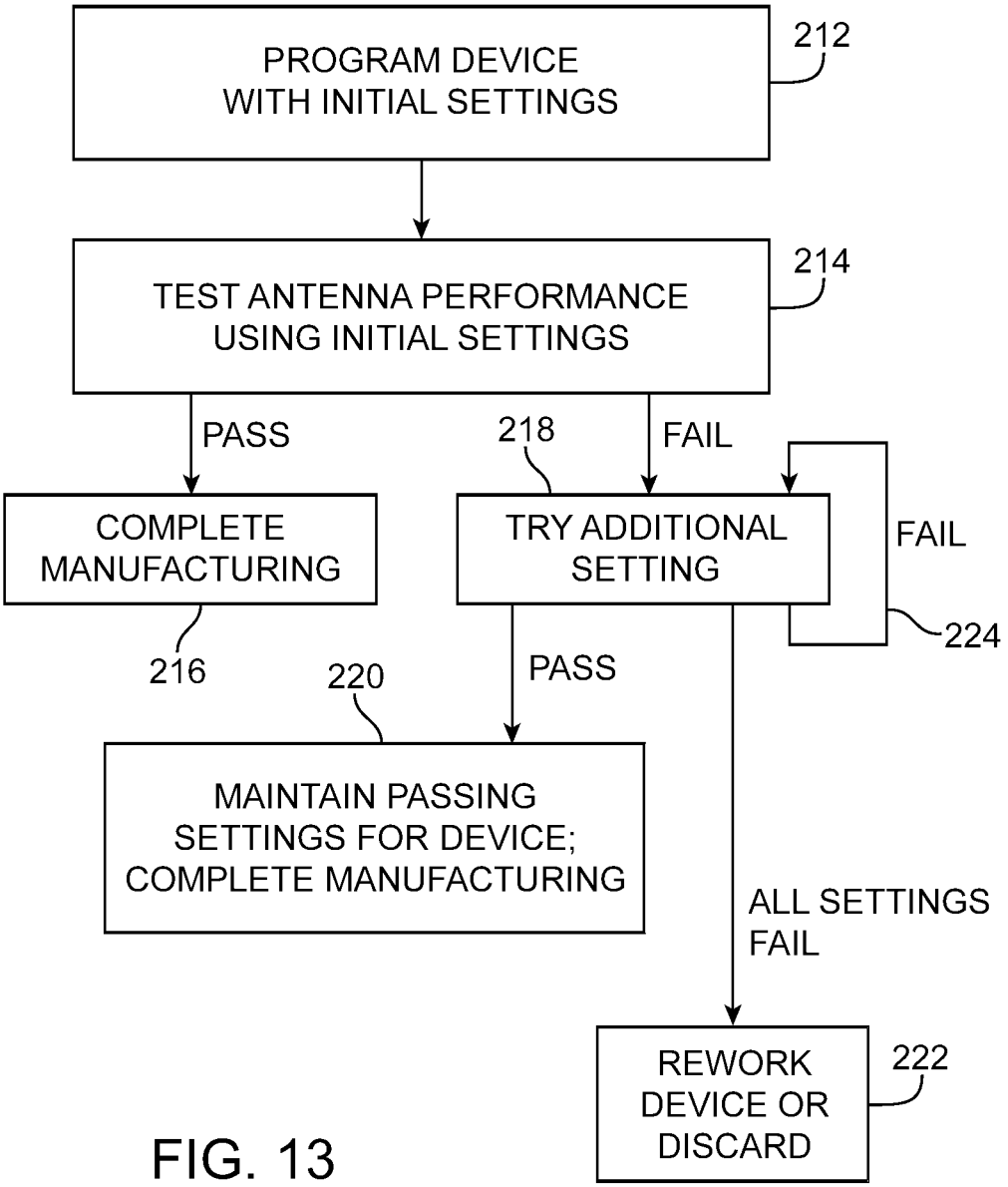
FIG. 13 is a flow chart of illustrative steps involved in manufacturing devices with calibrated wireless circuitry in accordance with an embodiment of the present invention.

A flow chart of illustrative operations associated with manufacturing an electronic device such as device 10 that includes antenna structures 40 with one or more adjustable components such as adjustable components 74 is shown in FIG. 13.

At step 212, device 10 may be programmed with initial (default) settings for adjustable components 74. The initial settings may be loaded into storage in storage and processing circuitry 28 using computing equipment such as a test system computer (e.g., host 132 or a computer associated with another test station that is used in manufacturing device 10).

At step 214, device 10 and test system 144 may cooperate to wirelessly test antenna structures 40 in device 10. For example, host 132 may direct device 10 to begin transmitting radio-frequency signals of a particular power across a range of frequencies while directing vector network analyzer 140 to measure corresponding received antenna signals or device 10 may be directed to measure received signals while vector network analyzer 140 is directed to transmit test signals. The antenna performance measurement data that is acquired during the operations of step 214 may be gathered by host 132 and stored in a results database on host 132 (as an example).

After gathering antenna performance measurements with system 144 during the operations of step 214, host 132 or other computing equipment may evaluate the antenna performance measurements to determine whether or not calibration data should be loaded into device 10. For example, a set of measurement data such as curve 200, 202, 204, or 206 in the example of FIG. 12 may be compared to satisfactory performance limits such as limits 208 and 210.

If the measured antenna performance data over all communications bands of interest satisfies desired limits and is therefore satisfactory for use in a finished device, device 10 may be considered to have passed testing. When device 10 passes testing at step 214, additional manufacturing operations may be performed, if desired (step 216). For example, software may be loaded onto device 10 by host 132 or other computing equipment, pieces of device housing 12 and/or internal electronic components may be used in completing device 10, or other manufacturing operations associated with completing device 10 may be performed. The finished device may be shipped to an end user.

If, however, the measured antenna performance data from the operations of step 214 is not satisfactory (i.e., because some or all of the measurements from step 214 exceed desired performance limits), device 10 may be considered to have failed testing with the initial antenna tuning settings. Accordingly, one or more additional antenna performance settings may be evaluated using the operations of step 218. Each antenna performance setting may correspond to a different setting for one or more adjustable components 74 (e.g., adjustable antenna components, adjustable matching circuit components, etc.).

If desired, an antenna may be placed in one or more configurations (e.g., tuned to operate in a low band mode, tuned to operate in a high band mode, etc.) during calibration, so that the antenna is calibrated over all desired communications bands of interest (e.g., with corresponding settings for adjustable components 74 in each band of interest).

Host 132 may provide device 10 with each trial set of adjustable component settings using path 134. If antenna performance with the new settings is not satisfactory, another set of trial settings may be used, as indicated by line 224. If antenna performance has been evaluated for all desired combinations of adjustable component settings, system 144 can conclude that settings adjustments through the use of calibration data will not be successful at restoring proper function to the antenna. Accordingly, the device may be removed from system 144 and discarded or reworked (step 222).

If, however, a set of satisfactory additional settings for adjustable components 74 can be identified during the operations of step 218, device 10 may be considered to have "passed" wireless testing. Processing may then continue to step 220. During the operations of step 220, device 10 may be instructed to use the satisfactory device settings for normal operation of device 10 in a wireless network. If the settings are presently loaded into storage and processing circuitry 28, those settings may be retained. With this approach, the calibration data may be stored in the storage of storage and processing circuitry 28 in response to having identified the appropriate calibration data during testing by virtue of retaining the calibration data and not overwriting the retained calibration data. If desired, the appropriately calibrated settings may be loaded during the operations of step 222 (i.e., in response to identifying the calibration data needed to properly calibrate device 10, the calibration data may be stored in the storage of storage and processing circuitry 28 by reloading the calibration data into the storage over path 134).

Calibration information may be provided to device 10 in the form of raw calibrated settings for adjustable components 74, in the form of offset values or formulas for use in computing calibrated settings for adjustable components 74 from raw settings in real time, using a combination of these approaches, or using any other suitable technique for ensuring that device 10 uses calibrated settings for one or more adjustable components 74 when operating tunable antenna structures 40 in device 10.

If device 10 has not been completely manufactured, final manufacturing operations may be performed at step 220 such as loading software onto device 10 from host 132 or other computing equipment, attaching pieces of device housing 12 and/or internal electronic components to device 10, or performing other manufacturing operations associated with completing device 10. The finished device may then be shipped to an end user.

Antenna calibration operations such as the operations of FIG. 13 may be performed for each tunable antenna in device 10.

The foregoing is merely illustrative of the principles of this invention and various modifications can be made by those skilled in the art without departing from the scope and spirit of the invention.

What is claimed is:

1. An electronic device, comprising:

a tunable antenna having an adjustable component that is operable to tune the antenna and that has multiple control lines; and control circuitry that is configured to provide digital control signals over the multiple control lines to tune the antenna, wherein the control circuitry produces the digital control signals by modifying calibration settings for the adjustable component using information that compensates for manufacturing variations in the electronic device.

2. The electronic device defined in claim 1 wherein the tunable antenna comprises an antenna resonating element and wherein the adjustable component is coupled to the antenna resonating element.

3. The electronic device defined in claim 1 further comprising:

radio-frequency transceiver circuitry; and an impedance matching circuit interposed between the tunable antenna and the radio-frequency transceiver circuitry, wherein the impedance matching circuit includes the adjustable component.

4. The electronic device defined in claim 1 wherein the adjustable component comprises an adjustable component selected from the group consisting of: an adjustable phase shift element, an adjustable capacitor, and an adjustable inductor.

5. The electronic device defined in claim 4 further comprising:

a peripheral conductive housing member, wherein at least part of the peripheral conductive housing member forms at least part of the tunable antenna.

6. The electronic device defined in claim 1 wherein the adjustable component comprises an adjustable phase-shift element.

7. The electronic device defined in claim 1 wherein the adjustable component comprises an adjustable capacitor.

8. The electronic device defined in claim 1 wherein the adjustable component comprises:

a digital control signal input configured to receive a digital control signal from the control circuitry; and a switch that is configured to receive the digital control signal from the digital control signal input; and a plurality of capacitors coupled to the switch.

9. The electronic device defined in claim 8 further comprising:

a peripheral conductive housing member, wherein at least part of the peripheral conductive housing member forms at least part of the tunable antenna.

10. The electronic device defined in claim 9 wherein the tunable antenna comprises an inverted-F antenna having at least one resonating element arm formed from the peripheral conductive housing member.

11. The electronic device defined in claim 10 wherein the adjustable component is coupled to the resonating element arm.

12. The electronic device defined in claim 10 further comprising:

radio-frequency transceiver circuitry; and an impedance matching circuit interposed between the tunable antenna and the radio-frequency transceiver circuitry, wherein the impedance matching circuit includes the adjustable component.

13. The electronic device defined in claim 1, wherein the information that compensates for manufacturing variations in the electronic device comprises a formula and the digital control signals are computed in real time based on the formula and the calibration settings for the adjustable component.

14. The electronic device defined in claim 1, wherein the adjustable component comprises:

multiplexing circuitry that receives the digital control signals and that adjusts a phase shift provided by the adjustable component based on the digital control signals.

15. The electronic device defined in claim 1, wherein the control circuitry adjusts raw calibration settings using the information that compensates for manufacturing variations to produce the digital control signals, the information that compensates for manufacturing variations comprises an offset, and the digital control signals are generated by applying the offset of the information that compensates for manufacturing variations to the raw calibration settings.

16. The electronic device defined in claim 1, wherein the adjustable component comprises:

multiplexing circuitry that receives the digital control signals and that adjusts an impedance of the adjustable component based on the digital control signals.

17. The electronic device defined in claim 1, wherein the tunable antenna comprises:

an antenna ground;

an antenna resonating arm; and an antenna feed branch coupled between the antenna resonating arm and the antenna ground, wherein the adjustable component is coupled in the antenna feed branch.

18. The electronic device defined in claim 17, further comprising:

a peripheral conductive housing member, wherein the antenna resonating arm of the tunable antenna is at least partially formed from a portion of the peripheral conductive housing member.

19. The electronic device defined in claim 1, wherein the adjustable component comprises:

an adjustable capacitor having a switch that adjusts a capacitance exhibited by the adjustable capacitor.

* * * * *